US006558143B2

(12) United States Patent
Nakajima et al.

(10) Patent No.: US 6,558,143 B2
(45) Date of Patent: May 6, 2003

(54) SCROLL COMPRESSORS

(75) Inventors: Naohiro Nakajima, Kariya (JP); Hiroyuki Gennami, Kariya (JP); Kazuhiro Kuroki, Kariya (JP); Kazuo Kobayashi, Kariya (JP); Shinji Tsubai, Kariya (JP); Yasushi Watanabe, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/952,167

(22) Filed: Sep. 13, 2001

(65) Prior Publication Data

US 2002/0057975 A1 May 16, 2002

(30) Foreign Application Priority Data

Sep. 18, 2000 (JP) ..... 2000-282276

(51) Int. Cl.[7] ..... F01C 1/02

(52) U.S. Cl. ..... 418/55.1; 418/188; 417/369; 184/6.12; 83/471.3

(58) Field of Search ..... 418/55.1, 188; 417/369; 184/6.12; 83/471.3

(56) References Cited

U.S. PATENT DOCUMENTS 4,157,045 A * 6/1979 Suzuki ..... 184/6.12
4,384,502 A * 5/1983 Dover ..... 83/471.3
6,089,840 A * 7/2000 Iizuka et al. ..... 418/55.5

FOREIGN PATENT DOCUMENTS

JP 02308990 A * 12/1990 ..... F04C/18/02
JP 06-264875 9/1994
JP 11-2194 1/1999
JP 11-022659 1/1999
JP 11-257260 9/1999
JP 2000-073973 3/2000

* cited by examiner

*Primary Examiner*—Thomas Denion
*Assistant Examiner*—Theresa Trieu
(74) *Attorney, Agent, or Firm*—Morgan & Finnegan, LLP

(57) ABSTRACT

Scroll compressors may include a stationary scroll, a drive shaft, a crank shaft coupled to the drive shaft, a bearing member coupled to the crank shaft and a movable scroll coupled to the crank shaft. The movable scroll is typically disposed adjacent to the stationary scroll. Further, the movable scroll preferably includes a boss that extends in the axial direction of the crank shaft. A spacer may be disposed between the boss and the bearing member and the spacer preferably transmits orbital movement of the crank shaft to the movable scroll. A compression chamber is defined by a space between the stationary scroll and the movable scroll. Fluid (e.g. a refrigerant gas) is compressed within the compression chamber when the movable scroll revolves or orbits with respect to the stationary scroll. A discharge port may be defined within the movable scroll and may be adapted to discharge the compressed fluid to a side that is opposite of the stationary scroll. A discharge valve is preferably coupled to the discharge port and is operable to open and close the discharge port. The discharge valve may, for example, include a reed valve and a retainer that holds the reed valve. Further, the spacer may be fixed to the inner circumferential surface of the boss by a frictional fit and may contact the discharge valve. The bearing member may be, e.g., a plain bearing or a needle bearing.

13 Claims, 1 Drawing Sheet

SCROLL COMPRESSORS

BACKGROUND OF THE INVENTION

1. Field of the Invention

The present invention relates to scroll compressors that may compress a fluid (e.g. a refrigerant gas) by utilizing stationary and movable scrolls and may discharge the compressed fluid via a discharge valve. The present invention particularly relates to scroll compressors that have a compact inner structure and that are utilized in vehicle air conditioning systems.

2. Description of the Related Art

A known scroll compressor is disclosed in the Japanese Laid-open Patent Publication No. H11-2194, which scroll compressor includes a drive shaft, a drive shaft member including a crank shaft coupled to the drive shaft, a stationary scroll and a movable scroll coupled to the crank shaft. A compression chamber is defined by a space between the stationary scroll and the movable scroll. When the drive shaft rotates, the drive shaft member rotates together with the drive shaft and, at the same time, the drive shaft member orbits or revolves around a rotational axis. The revolution or orbital movement of the drive shaft member is transmitted to the movable scroll by means of a bearing member provided between the drive shaft member and the movable scroll. When the movable scroll orbits with respect to the stationary scroll, the volume of the compression chamber is reduced and thus, the fluid drawn into the compression chamber is compressed and discharged from the discharge port. The discharge port is defined within the movable scroll in accordance with the compression chamber in its minimum volume. The discharge port is opened and closed by means of a discharge valve. When the discharge valve closes the discharge port, backflow of the compressed fluid to the compression chamber can be prevented. On the other hand, when the discharge valve opens the discharge port, the compressed fluid can be discharged from the discharge port.

In order to reduce energy loss during operation of the scroll compressor, it is necessary to reduce heat generation caused by the crank shaft frictionally contacting the bearing member. Thus, in order to reduce such heat generation, the surface areas of the crank shaft and the bearing member have been reduced by reducing the diameters of the crank shaft and the bearing member. However, the portion of the movable scroll that includes the discharge valve consequently will also be reduced when the diameters of the crank shaft and the bearing member are reduced. As a result, the discharge valve also must be reduced in size, thereby limiting design options for the discharge valve.

SUMMARY OF THE INVENTION

It is, therefore, an object of the invention to provide improved scroll compressors that can reduce energy loss due to heat generation caused by frictional contact between the rotating portions of the scroll compressor, while still providing sufficient area to install a discharge valve.

In scroll compressors according to the present teachings, a crank shaft is coupled to a movable scroll and the movable scroll revolves or orbits via a bearing member. Further, a spacer may be disposed between a boss of the movable scroll and the bearing member.

According to the present teachings, because the spacer is provided between the boss and the bearing member, the diameter of the bearing member can be reduced, while not reducing the diameter of the boss. That is, movable scroll can have a sufficient area to mount a discharge valve and therefore, it is not necessary to reduce the dimension of a discharge valve. On the other hand, heat generation due to frictional contact between the boss and the bearing member can be reduced, because the diameter of the bearing member and the diameter of the crank shaft can be reduced by means of the spacer. Therefore, a compact space design of the scroll compressors can be realized.

Other objects, features and advantage of the present invention will be readily understood after reading the following detailed description together with the accompanying drawings and the claims.

DETAILED DESCRIPTION OF THE INVENTION

Figure 1:
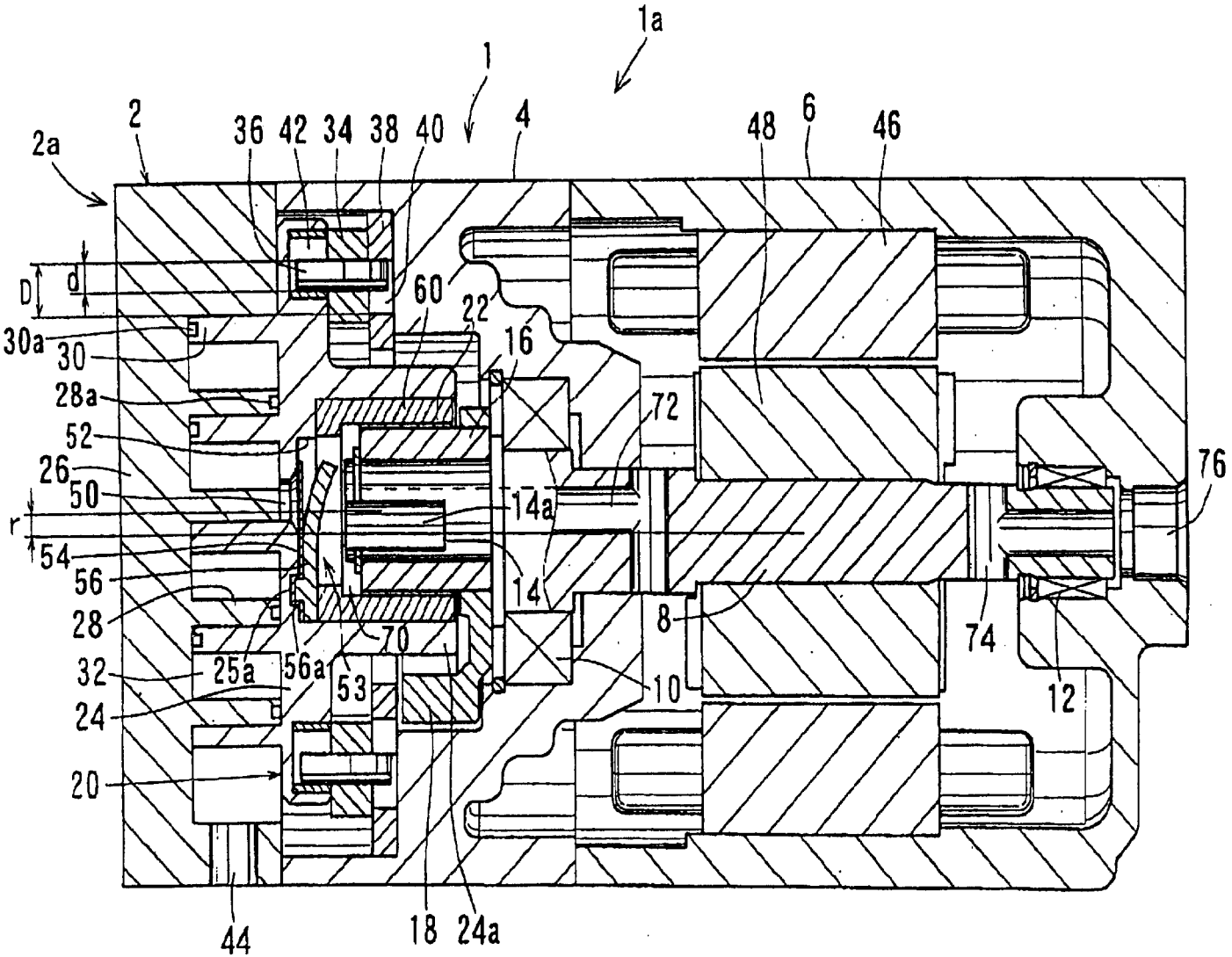
FIG. 1 shows a scroll compressor according to the representative embodiment.

Representative scroll compressor may include, for example, a stationary scroll, a drive shaft, a crank shaft, a bearing member, a movable scroll with a boss, a spacer, a compression chamber, a discharge port and a discharge valve.

The crank shaft may be coupled to the drive shaft and the bearing member may be coupled to the crank shaft. The movable scroll may be coupled to the crank shaft and thus, will orbit or revolve about the rotational axis of the drive shaft when the drive shaft rotates. The boss of the movable scroll may extend in the axial direction of the crank shaft. The spacer may be disposed between the boss and the bearing member. The compression chamber may be defined by a space between the stationary scroll and the movable scroll. Thus, fluid drawn into the compression chamber may be compressed within the compression chamber when the movable scroll revolves or orbits with respect to the stationary scroll. The discharge port may be defined within the movable scroll to discharge the compressed fluid to the opposite side of the stationary scroll and the discharge valve may open and close the discharge port.

The bearing member is preferably coupled to the boss via the spacer. Thus, the orbital movement of the crank shaft may be transmitted to the boss of the movable scroll via the bearing member. The bearing member is not required to have the same diameter as the boss, because the spacer is disposed between the bearing member and the boss. Thus, the bearing member can have a relatively small dimension. Therefore, heat generation caused by frictional contact of the bearing member with the crank shaft can be reduced and energy loss can be minimized during operation of the scroll compressor. Further, the boss is not required to have the same diameter as the bearing member, because the spacer is disposed between the boss and the bearing member. Therefore, it is not necessary to reduce the dimensions of the movable scroll and thus, sufficient area for defining the discharge valve within the movable scroll can be provided.

In another aspect of the present teachings, the discharge valve may preferably include a reed valve and a retainer that holds the reed valve. Preferably, the spacer may be fixed to the inner circumferential surface of the boss and makes contact with the discharge valve. In this connection, when the discharge valve is defined by the reed valve and the retainer, the spacer may preferably contact with the retainer that holds the reed valve. By fixing the spacer to the boss, the reed valve provided on the movable scroll can be held by the spacer together with the retainer, wherein the spacer is also provided on the movable scroll. Therefore, the relative displacement of the discharge valve with respect to the spacer can be prevented. Further, the bearing member may preferably be a plain or needle bearing.

Each of the additional features and method steps disclosed above and below may be utilized separately or in conjunction with other features and method steps to provide improved scroll compressors and methods for designing and using such scroll compressors. Representative examples of the present invention, which examples utilize many of these additional features and method steps in conjunction, will now be described in detail with reference to the drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe some representative examples of the invention, which detailed description will now be given with reference to the accompanying drawings.

A representative scroll compressor 1 is shown in FIG. 1 and may preferably be utilized within a refrigerant circulation circuit in a vehicle air-conditioning system. As shown in FIG. 1, the representative scroll compressor 1 includes a housing 1*a* defined by a center housing 4, a motor housing 6 and an end housing 2*a*. A stationary scroll 2 is disposed within the end housing 2*a*. A movable scroll 20 and other devices that drive the movable scroll 20 are also disposed within the housing 1*a*. One end surface of the center housing 4 is coupled to the end housing 2*a* and another end surface of the center housing 4 is coupled to the motor housing 6. A drive shaft 8 is rotatably supported by radial bearings 10 and 12 in both the center housing 4 and the motor housing 6. Within the center housing 4, a crank shaft 14 is integrally coupled to the end of the drive shaft 8.

Two mutually parallel planar portions 14*a* are formed on the crank shaft 14. In FIG. 1, however, only one planar portion 14*a* is shown for the sake of convenience of explanation. A bush 16 is joined to the crank shaft 14 by means of the planar portions 14*a* so that the bush 16 may rotate together with the crank shaft 14. A balancing weight 18 is attached to one end of the bush 16 so that the balancing weight 18 can rotate together with the crank shaft 14. The movable scroll 20 includes a tubular boss 24*a* that is provided on the surface opposite to the stationary scroll 2 (on the right side of the movable scroll 20 in FIG. 1). Further, a plain bearing 22 couples the bush 16 to the inner circumferential surface of the boss 24*a* via a spacer ring 60. The plain bearing 22 is one representative example of a "bearing member" as utilized in the present specification and claims.

The stationary scroll 2 includes a stationary volute wall 28 that protrudes from a base plate 26 of the stationary scroll 2 towards the movable scroll 20. The movable scroll 20 includes a movable volute wall 30 that protrudes from the base plate 24 of the movable scroll 20 towards the stationary scroll 2. The stationary volute wall 28 and the movable volute wall 30 are disposed adjacent to each other and preferably aligned to engage or mesh with each other. An end seal 28*a* is provided on the top end of the stationary volute wall 28 and an end seal 30*a* is provided on the top end of the movable volute wall 30. The volute walls are also known in the art as spiral wraps and these terms can be utilized interchangeably.

The stationary volute wall 28 and the movable volute wall 30 make contact with each other and are positioned in meshing engagement. As the result, a compression chamber 32 with a crescent shape is defined within a space surrounded by the stationary scroll base plate 26, the stationary volute wall 28, the movable scroll base plate 24 and the movable volute wall 30. When the drive shaft 8 rotates, the crank shaft 14 revolves or orbits around the rotational axis of the drive shaft 8. The rotational axis may be defined as the center, longitudinal axis of the drive shaft 8. Thus, the distance between the crank shaft 14 and the rotational axis of the drive shaft 8 defines the diameter of the orbital path. When the movable scroll 20 revolves or orbits about the rotational axis of the drive shaft 8, the balancing weight 18 offsets the centrifugal force caused by the revolution of the movable scroll 20.

A discharge port 50 is defined within the base plate 24 of the movable scroll 20. Further, a reed valve 54 is provided within a valve storage chamber 52. The valve storage chamber 52 is defined by a space on the rear surface (the surface opposing the crank shaft 14) of the base plate 24 of the movable scroll 20. The reed valve 54 is disposed to face the discharge port 50 in order to open and close the discharge port 50. A retainer 56 holds the reed valve 54. Within the valve storage chamber 52, the reed valve 54 and the retainer 56 are fixed to the rear surface of the base plate 24 of the movable scroll 20 by means of a convex-concave structure. That is, a convex portion 56*a* of the reed valve 54 is engaged with a concave portion 25*a* of the movable scroll 20. The concave portion 25*a* can be defined as a positioning groove for the reed valve 54.

The spacer ring 60 is disposed between the inner circumferential surface of the boss 24*a* and the outer circumferential surface of the plain bearing 22. The spacer ring 60 is one representative example of a "spacer" and/or "means for spacing" as utilized in the present specification and claims. The spacer ring 60 is preferably fixed to the inner surface of the boss 24*a* by pressure-joining (i.e. a frictional fit). Thus, the orbital movement of the crank shaft 14 can be transmitted to the boss 24*a* of the movable scroll 20 via the plain bearing 22 and the spacer ring 60. Due to the spacer ring 60, the plain bearing 22 is not required to have the same diameter as the diameter of the inner circumference of the boss 24*a*. As the result, the plain bearing 22 can have a relatively small dimension and therefore, heat generation between the plain bearing 22 and the crank shaft 14 can be reduced. Thus, energy loss can be minimized during operation of the scroll compressor 1. Moreover, the boss 24*a* is not required to have the same diameter as the diameter of outer surface of the plain bearing 22 due to the spacer ring 60. Therefore, it is not necessary to reduce the dimensions of the movable scroll 20 and sufficient area for installing the reed valve 54 within the movable scroll 20 can be provided.

Further, the front end of the spacer ring 60 (left end portion in FIG. 1) makes contact with the retainer 56 and clamps the reed valve 54. That is, the reed valve 54 is clamped by the spacer ring 60 and the base plate 24 of the movable scroll 20. As the result, it is not necessary to provide a specific structural element, such as a bolt, to fix the reed valve 54. Thus, the total number of parts that form the scroll compressor 1 can be reduced.

Moreover, because the spacer ring 60 is utilized in the scroll compressor 1, the thickness of the bearing member with respect to the radial direction of the crank shaft 14 can be reduced and a tight gas-seal can be realized.

When the drive shaft 8 rotates, the crank shaft 14 rotates around the rotational axis of the drive shaft 8. Thus, the crank shaft 14 will orbit along a pre-determined circular path. In addition, the orbital diameter of the revolution is defined by the distance between the crank shaft 14 and the rotational axis of the drive shaft 8.

A rotary ring 34 is disposed between the base plate 24 of the movable scroll 20 and the center housing 4. The rotary ring 34 includes auto-rotation preventing pins 36 that penetrate toward the movable scroll 20. In this embodiment, a total of four auto-rotation preventing pins 36 are provided. However, only two auto-rotation preventing pins 36 are shown in FIG. 1. A bearing plate 38 is provided between the center housing 4 and the rotary ring 34. Each auto-rotation preventing pin 36 respectively engages with an auto-rotation preventing hole 40 defined within the bearing plate 38. Further, each auto-rotation preventing pin 36 respectively engages with an auto-rotation preventing hole 42 defined within base plate 24 of the movable scroll 20. The end portion of the auto-rotation preventing pin 36 is inserted into each corresponding auto-rotation preventing holes 40, 42.

A stator 46 is provided on the inner circumferential surface of the motor housing 6. Further, a rotor 48 is coupled to the drive shaft 8. The stator 46 and the rotor 48 define an electric motor that rotates the drive shaft B. Thus, the present scroll compressors are particularly useful for hybrid or electric cars that operate using electric power. However, an electric motor is not essential to the present teachings and the present scroll compressor can be easily modified for use with internal combustion engines.

While the crank shaft 14 rotates and revolves, the movable scroll 20 is prevented from auto-rotating because the inner circumferences of the respective auto-rotation preventing holes 42 contact the auto-rotation preventing pins 36 on the rotary ring 34.

When the crank shaft 14 rotates, the movable scroll 20 connected to the crank shaft 14 by means of the plain bearing 22 and the spacer ring 60 orbits or revolves along a circular path. When the movable scroll 20 revolves in conjunction with the stationary scroll 2, the refrigerant gas (fluid) is drawn from the suction port 44 into the compression chamber 32 and the compression chamber 32 reduces the volume of the refrigerant gas toward the center of the stationary and movable scrolls 2, 20. Due to the volume reduction of the compression chamber 32, the refrigerant gas is compressed and reaches a high pressure state.

The rear surface of the base plate 24 of the movable scroll 20 faces a high-pressure chamber 53 that is defined by the valve storage chamber 52 and a space 70. The reed valve 54 is opened and closed based upon the pressure difference between the pressure within the high-pressure chamber 53 and the pressure within the compression chamber 32 (or within the discharge port 50). The reed valve 54 opens the discharge port 50 when the pressure within the compression chamber 32 is greater than the pressure within the high-pressure chamber 53. The reed valve 54 closes the discharge port 50 when the pressure within the compression chamber 32 is lower than the pressure within the high-pressure chamber 53. The retainer 56 holds the reed valve 54 and also defines the maximum aperture of the reed valve 54.

The compressed high-pressure refrigerant gas is discharged from the discharge port 50 to the high-pressure chamber 53 when the reed valve 54 opens the discharge port 50. The space 70 of the high-pressure chamber 53 communicates with the interior of the motor housing 6 via a passage 72 formed inside the crank shaft 14 and the drive shaft 8. Further, the refrigerant gas introduced into the motor housing 6 is discharged from the passage 74 provided in the drive shaft 8 to an external air conditioning circuit via an outlet 76 formed in a wall portion of the motor housing 6. Because the refrigerant gas is communicated through the interior of the motor housing 6, the refrigerant gas can cool the electric motor (i.e. rotor 48 and stator 46) during operation.

When the drive shaft 8 rotates together with the crank shaft 14, the crank shaft 14 revolves (orbits) around the rotational axis of the drive shaft 8. Also, the crank shaft 14 rotates around its auto-rotating axis (which is same as the rotational axis of the crank shaft 14). However, the auto-rotation preventing pin 36 only permits the movable scroll 20 to receive the orbital movement of the crank shaft 14 by means of the plain bearing 22. Further, the auto-rotation of the crank shaft 14 will not be transmitted to the movable scroll due to the auto-rotation preventing pin 36. As a result of the orbital movement of the movable scroll 20 with respect to the stationary scroll 2, refrigerant gas (fluid) is drawn from a suction port 44 into the compression chamber 32, which is defined between the stationary scroll 2 and the movable scroll 20. In conjunction with the revolution of the movable scroll 20, the surface of the auto-rotation preventing pin 36 slides along the surface of the respective auto-rotation preventing holes 40 and 42. The inner diameter "D" of the auto-rotation preventing holes 40, 42, the outer diameter "d" of the auto-rotation preventing pins 36, and the revolutionary (orbital) radius "r" of the bush 16 are preferably defined in a relationship such as "D=d+r". Due to this relationship, the revolutionary (orbital) radius of the movable scroll 20 is defined by "r", and the rotary ring 34 revolves at a radius that is one-half of the revolutionary radius "r" of the movable scroll 20.

As described above, the spacer ring 60 is provided between the inner circumferential surface of the boss 24*a* and the outer circumferential surface of the plain bearing 22. Therefore, the thickness of the bearing member with respect to the radial direction of the crank shaft 14 can be reduced, while maintaining the relatively large dimension of the inner circumferential diameter of the boss 24*a*. As the result, a gas-tight seal can be realized with high efficiency and sufficient area for installing the reed valve 54 within the movable scroll 20 can be secured.

Further, it is preferable to provide a seal (not shown) between the outer surface of the bush 16 and inner surface of the boss 24*a* in order to prevent the compressed high-pressure fluid from leaking to any lower-pressure chamber within the housing 1*a* via the clearance between the bush 16 and the boss 24*a*. For example, an elastically deformable annular ring or a plain bearing may be utilized as the seal.

Further techniques for making and using scroll compressors are taught in a US patent application filed on even date herewith entitled "Scroll Compressors" naming Shinji Tsubai, Hiroyuki Gennami, Kazuhiro Kuroki, Kazuo Kobayashi and Naohiro Nakajima as inventors and claiming Paris Convention priority to Japanese patent application Ser. No. 2000-278506 and a US patent application filed on even date herewith entitled "Scroll Compressors" naming Hiroyuki Gennami, Kazuhiro Kuroki, Kazuo Kobayashi, Shinji Tsubai, Naohiro Nakajima and Masahiro Kawaguchi as inventors and claiming Paris Convention priority to Japanese patent application serial number 2000-280457, all of which are commonly assigned and are incorporated by reference as if fully set forth herein.

What is claimed is:

1. A scroll compressor comprising:

a stationary scroll, a drive shaft, a crank shaft coupled to the drive shaft, a bearing member coupled to the crank shaft, a movable scroll coupled to the crank shaft, the movable scroll disposed adjacent to the stationary scroll, wherein the movable scroll includes a boss that extends in the axial direction of the crank shaft, a spacer disposed between the boss and the bearing member, the spacer transmitting orbital movement of the crank shaft to the movable scroll, a compression chamber defined by a space between the stationary scroll and the movable scroll, wherein fluid is compressed within the compression chamber when the movable scroll revolves or orbits with respect to the stationary scroll, a discharge port defined within the movable scroll and adapted to discharge the compressed fluid to a side that is opposite of the stationary scroll, a reed valve disposed to face the discharge port operable to open and close the discharge port, and a retainer that holds the reed valve wherein the front end of the spacer makes contact with the retainer and clamps the reed valve.

2. A scroll compressor according to claim 1, wherein the discharge valve comprises a reed valve and a retainer that holds the reed valve.

3. A scroll compressor according to claim 1, wherein the spacer is fixed to the inner circumferential surface of the boss by a frictional fit and contacts the discharge valve.

4. A scroll compressor according to claim 1, wherein the bearing member is a plain bearing.

5. A scroll compressor according to claim 1, wherein the bearing member is a needle bearing.

6. A scroll compressor according to claim 1, further comprising an electric motor disposed within a motor housing, wherein the motor housing is in communication with the discharge port, the electric motor is coupled to and drives the drive shaft and wherein compressed fluid from the compression chamber is introduced into the motor housing via the discharge port in order to cool the electric motor during operation.

7. A scroll compressor comprising:

a stationary scroll, a drive shaft, a crank shaft coupled to the drive shaft, a bearing member coupled to the crank shaft, a movable scroll coupled to the crank shaft, the movable scroll disposed adjacent to the stationary scroll, wherein the movable scroll includes a boss that extends in the axial direction of the crank shaft, means for spacing the boss from the bearing member, a compression chamber defined by a space between the stationary scroll and the movable scroll, wherein fluid is compressed within the compression chamber when the movable scroll revolves or orbits with respect to the stationary scroll, a discharge port defined within the movable scroll and adapted to discharge the compressed fluid to a side that is opposite of the stationary scroll, and a reed valve disposed to face the discharge port operable to open and close the discharge port, and a retainer that holds the reed valve wherein the front end of the spacer makes contact with the retainer and clamps the reed valve.

8. A scroll compressor according to claim 7, wherein the discharge valve comprises a reed valve and a retainer that holds the reed valve.

9. A scroll compressor according to claim 7, wherein the spacing means is fixed to the inner circumferential surface of the boss by a frictional fit and contacts the discharge valve.

10. A scroll compressor according to claim 7, further comprising an electric motor disposed within a motor housing, wherein the motor housing is in communication with the discharge port, the electric motor is coupled to and drives the drive shaft and wherein compressed fluid from the compression chamber is introduced into the motor housing via the discharge port in order to cool the electric motor during operation.

11. A scroll compressor according claim 7, wherein the spacing means comprises a spacer ring.

12. A scroll compressor according to claim 7, wherein the bearing member is a plain bearing.

13. A scroll compressor according to claim 7, wherein the bearing member is a needle bearing.

* * * * *